United States Patent [19]

Herzhoff et al.

[11] 3,983,839

[45] Oct. 5, 1976

[54] MULTIPLE COATING APPARATUS

[75] Inventors: Peter Herzhoff, Leverkusen; Hans Gref, Cologne; Wolfgang Schweicher, Leverkusen; Hans Frenken, Leverkusen; Karl Voss, Leverkusen; Stephan Platz, Leverkusen; Gunther Koepke, Leverkusen; Georg Brauniger, Cologne, all of Germany

[73] Assignee: AGFA-Gevaert, A.G., Leverkusen, Germany

[22] Filed: Nov. 17, 1972

[21] Appl. No.: 307,336

Related U.S. Application Data

[62] Division of Ser. No. 95,210, Dec. 4, 1970, Pat. No. 3,793,051.

[30] Foreign Application Priority Data

Dec. 11, 1969 Germany ..... 1962089

[52] U.S. Cl. ..... 118/50; 118/67; 34/159

[51] Int. Cl.[2] ..... B05C 11/00

[58] Field of Search ..... 118/67, 65, 50, 68, 118/61; 34/160, 92, 156, 159; 226/190, 95

[56] References Cited

UNITED STATES PATENTS

| | | | |
|---|---|---|---|
| 1,560,579 | 11/1925 | Jones | 226/190 X |
| 2,333,220 | 11/1943 | Weiss | 34/160 X |
| 3,367,039 | 2/1968 | Jacobsen | 34/159 X |
| 3,403,456 | 10/1968 | Smith, Jr. | 34/160 |
| 3,549,004 | 12/1970 | Zysman | 226/95 X |

FOREIGN PATENTS OR APPLICATIONS

| | | |
|---|---|---|
| 1,597,656 | 6/1970 | Germany |

*Primary Examiner*—John P. McIntosh
*Attorney, Agent, or Firm*—Connolly and Hutz

[57] ABSTRACT

An arrangement for the production of webs coated with several emulsions, comprising coating and drying means arranged in succession, in the latter being connected to air supply and discharge shafts. A plurality of coating means are arranged at a selectable spacing from one another along the web which is guided in loop formation, the physical parameters for coating and drying are adjustable for each layer.

30 Claims, 9 Drawing Figures

MULTIPLE COATING APPARATUS

This is a division of U.S. patent application Ser. No. 95,210, filed Dec. 4, 1970, now U.S. Pat. No. 3,793,051, issued Feb. 19, 1974.

This invention relates to a means for producing webs with a multiple coating of photographic emulsions. In such a case, coating and drying means are arranged alternately in succession, the drying means consisting of air supply and discharge shafts.

Coating plants having two coating arrangements are already known. In these known arrangements, the film web is guided from the first coating arrangement through a solidifying section to the next coating arrangement and then through a solidifying section into a drier. The emulsion is prepared in a melting chamber and flows to the coating arrangements. The section of the plant comprising the coating arrangements and the solidifying sections is generally known as the coating machine. The construction of the coating machine is determined by the requirement that the web should be guided without any contact of the coated side with rollers from the first to the second coating arrangement. It is because of this requirement that helical web guiding means is for example provided as is known. Suspension or channel driers are driers for coating plants are known. The drying air is conducted by a circulated air system, in which the air is always circulated in the same drying section, or in a helical system, in which the air is always conducted on to the next following section.

A more recent development consists in coating several layers without intermediate drying in a single multi-layer coating device. Multi-layer coating devices are known which can easily be incorporated into a conventional coating plant.

However, this known process also has disadvantages. The ratio between the thicknesses of the layers which are simultaneously to be applied can only be freely selected within limits and it is dependent on the viscosity and wetting ratios.

Usually, the multi-layer emulsion web preformed by means of the coating arrangement is stretched on being transferred to the support. Therefore, the spinnability of the emulsions is to be taken into account.

Consequently, in view of the coating operation, it is frequently necessary to provide the coating solutions with additives which influence their flow behaviour, in order to obtain satisfactory casting qualities of the separate layers.

Such additives often impair the technological properties of the products and, at best only mean a restriction of the manipulation latitude for producing extremely constant and thin layers at high working speeds.

Often different coating systems are suitable for the separate layers. It should therefore be possible individually to select the coating system.

Each separate layer sets different requirements as regards the desired physical conditions existing during the drying. The essential variables of state, such as temperature, moisture content and flow velocity of the air, and also the drying time for the respectively required residual water content, should therefore be freely selectable for each layer if it is desired to produce optimum technological properties and highest output of the plant. It should thus be possible to use individual coating systems for the application of the separate layers.

The object as described above is achieved according to the invention, in connection with an arrangement having coating and drying means arranged in succession, comprising a plurality of coating means arranged at a variable spacing from one another along the web guided in loop formation, the physical parameters important for the coating and drying being adjustable on each coating and drying means for each layer. As coating means, types of coating units of the same or different types can be used, such as air brush or extruder casting units.

According to a preferred embodiment of the invention, the air discharge shafts of a drying means respectively open into a return air duct, and this duct, for the production of different air paths, is connected through adjustable and closable flaps to a ventilator mixing chamber belonging to the respective section and such a chamber belonging to the next section, and to a moist air duct which is common to all drying means. The return air duct is advantageously connected by way of adjustable and closable flaps or dampers to a bypass duct which is common to all drying means, the latter duct being capable of subdivision by partitions, while each mixing chamber is in its turn connected by way of adjustable and closable flaps or dampers to the drying air duct and by-pass duct.

In order to be able to dry the coated web in a drying means successively at different temperatures, the air supply shaft is subdivided into at least two ducts which can be separately heated and which communicate in the different sections of the drying means with a set of slit nozzles.

The plant preferably consists of at least two similar structural elements, which respectively comprise that portion of the machine frame for guiding the web, the drying means and the drying air supply and also space for a coating means and the associated emulsion preparation stage. The construction readily allows a certain freedom in the choice of the drying time necessary for a coated web element. If in fact the coating means is omitted at the place provided for it between two drying means and is replaced by a simple guide arrangement or if the web travels through an existing coating means without being coated, the drying time is doubled. By appropriate choice of the location for a coating means, it thus becomes posible for the separate layers to be dried for different drying times.

The mixing chambers are advantageously so arranged that their partition walls are offset from the partition walls of adjoining return air ducts by the length of half a mixing chamber.

The air supply and discharge shafts of a drying means are arranged in a common housing which is subdivided by partitions and formed with openings towards the web, a machine frame for guiding the web always being arranged between two of these housings. The machine frame for guiding the web is formed as a suction shaft. The suction shaft is provided towards the adjoining housings with web-guiding rollers, and respectively two web-guiding rollers form a two-roller hollow forming suction unit. Openings for discharging the air drawn in by the said suction unit are arranged in the walls of the suction shaft after the web-guiding rollers.

A particularly good guiding action for the web in the vicinity of a coating means is obtained by a hollow-forming suction unit extending directly up the casting roller of the coating means and provided with a plurality of guide rollers arranged in parallel disposed at the bottom end of the suction shaft. In this way, webs of a nature which cannot be unwound without tension exactly into one plane are guided in the region of the coating roller without any formation of creases or deformation. For a satisfactory coating operation, the web should lie uniformly everywhere on the casting roller.

The drying means according to the invention are not restricted in their use to the coating arrangement which has been described. They can in principle be used in all those cases where an intermediate drying is necessary with application of several layers.

As regards the drying, the advantages which are produced by the invention consist more especially in that the drying characteristic for the individual layers can be chosen in the best possible manner. A circulating air or helical system is possible. Due to the by-pass duct, the possibility also exists of by-passing one or more drying sections.

The advantages produced by the invention consist more especially in that the drying conditions for the separate layers can be chosen in optimum manner. Because of the by-pass duct, it is also possible for one or more drying sections to be by-passed.

By the arrangement of the ducts and air shafts according to the invention, complicated pipe conduit systems for the conduction of drying air are avoided, since the air chamber system is repeated in each section and the necessary flaps or shutters are arranged in the partitions.

One embodiment of the invention is to be more fully described by way of example and by reference to drawings, wherein.

Figure 1:
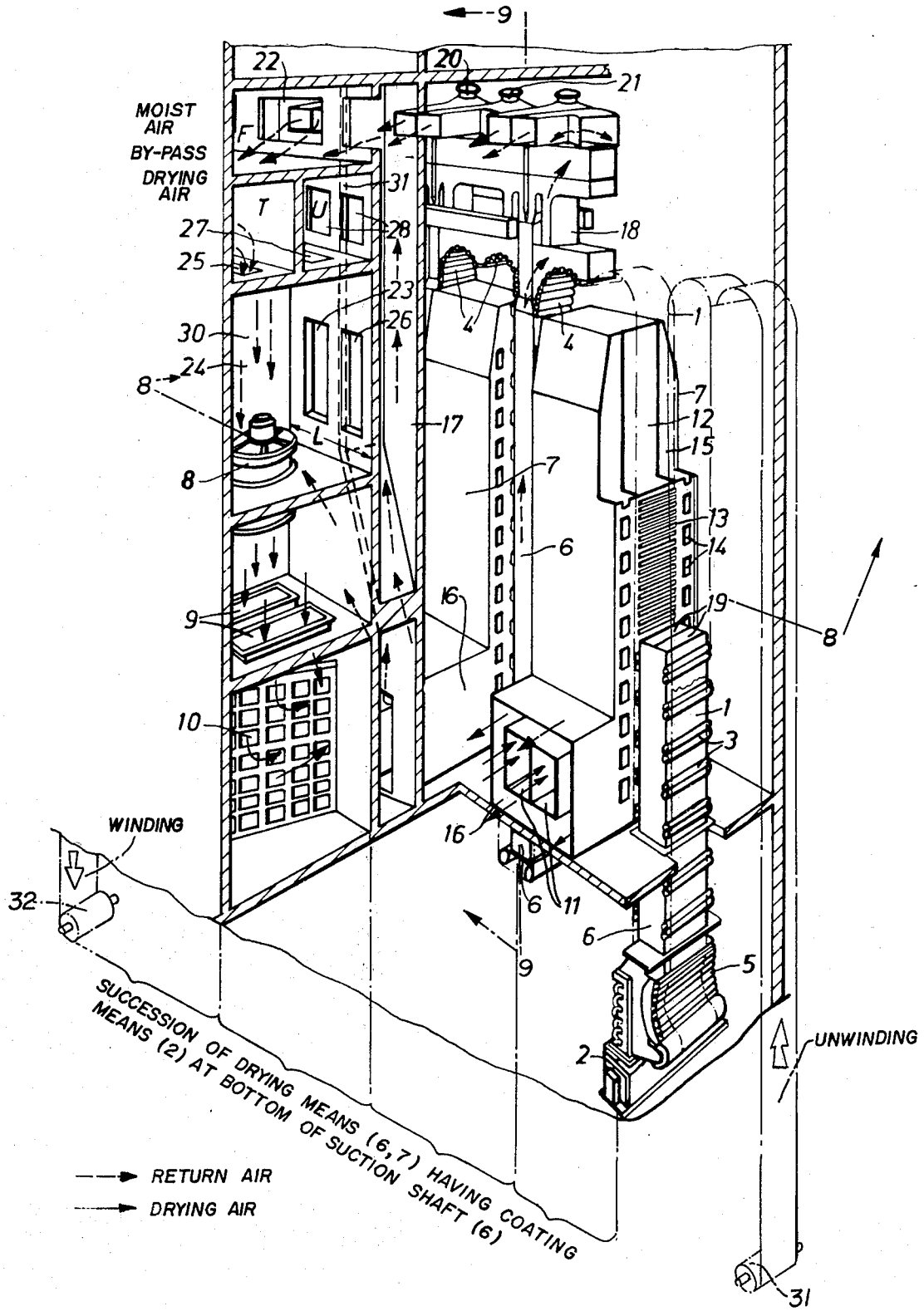
FIG. 1 is a perspective view in section through the coating and drying plant, from which the guiding of the web can be more clearly seen.

In FIG. 1, a film or paper web 1, coming from an unwinding vertical 31 which is schematically shown, is guided in vertical loops through the coating and drying plant and then is conveyed to a winding arrangement 32, which also is schematically shown.

Arranged at each second base point of the loops is a coating means 2.

In the straight sections of the loops, the web is guided over two-roller hollow-forming suction units 3, in order to avoid turning over the edges. The guiding of the layer side at the upper end of the loops is effected by means of curved hollow-forming suction units 4. Suction units 5 are also arranged in the vicinity of the coating means in order to produce a good support of the web on the casting roller, also with low-rigidity webs.

The arrangement for the production of webs coated with several photographic emulsions, comprises coating and drying means arranged in succession and with air supply and discharge shafts, wherein a plurality of coating means are arranged at a selectable spacing from one another along the web which is guided in loop formation, the physical parameters important for the coating and drying being adjustable at each coating means 2 and drying means 7 for each layer.

The air discharge shafts 15 of a drying means respectively open through the duct 16 into a return air duct 17 which, for producing different air supply paths, is connected by means of adjustable and closable flaps or dampers 22, 23, 26 with a fan and mixing chamber belonging to the respective section and a fan and mixing chamber belonging to the next section, and is connected to a moist air duct F which is common to all drying means.

The return air duct 17 is connected by way of adjustable and closable dampers 28 to a by-pass duct U which is common to all drying means and which can be subdivided by partitions 29.

Each mixing chamber 24 is connected through adjustable and closable dampers 25, 27 to the drying air duct T and the by-pass duct U.

The air supply shaft 12 of a drying means 7 is respectively subdivided into at least two ducts 11 which can be separately heated and which communicate at different section of the drying means 7 with a set of slit nozzles 13.

The plant consists of at least two identical structural elements, which respectively contain that portion of the machine frame for guiding the web of the drying means 7 and of the drying air supply, as well as the place for a coating means 2 and the associated preparation of the emulsion, which portion corresponds to the element.

The partitions 30 between adjacent mixing chambers 24 are offset from the partitions 31 of adjacent return air ducts 17 by half the length L of a mixing chamber.

The air supply shaft 12 and air discharge shaft 15 are arranged in a common housing which is subdivided by partitions and is provided towards the web 1 with openings 13, 14, a machine frame for guiding the web being arranged in each case between two of these housings.

The machine frame is constructed as a suction shaft 6 which is provided towards the adjacent housings with web-guiding rollers, two web-guiding rollers in each case forming a two-roller hollow-forming suction unit 3, and that openings for the discharge of the air drawn in through the two-roller suction unit are arranged behind the web-guiding rollers in the walls of the suction shaft.

The bottom end of each suction shaft 6 is provided with a hollow-forming suction unit which extends directly up to the casting roller of the coating means 2 and is provided with a plurality of guide rollers 5 arranged in parallel relation.

It is to be noted that as regards the construction of the plant, there is no longer any distinction between coating machine, solidifying section and drying section. The functions which are associated with these terms are combined in a constructional unit which is repeated and which consists substantially of a suction shaft 6 representing the machine framd and a drying means 7.

The diagrams in FIGS. 3 to 7 show various possibilities as regards the path or guiding of the drying air.

The rectangles indicated at *m*, *n*, *o*, *p* and *q* represent five drying means disposed side-by-side. The drying air produced in an air-preparing plant is supplied by way of a drying air header duct T to the drying means. The air, enriched with water, is wholly or partially discharged through a moist air header duct F, depending on the circuit arrangement. In addition, a by-pass duct U is provided (this only being shown in FIGS. 6 and 7).

Shut-off members, fans, heaters and the like are not shown, so as not to complicate the drawings.

Figure 3:
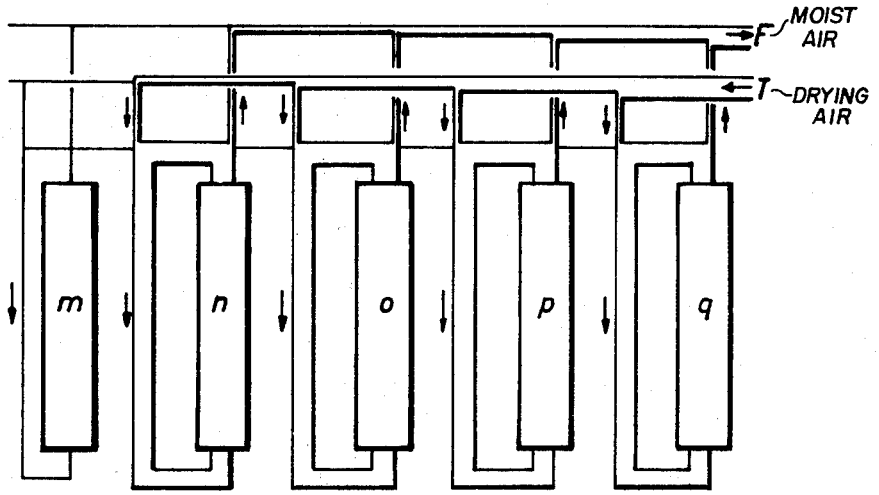
FIGS. 3 to 7 are block diagrams for different possibilities as regards the path of the drying air.

FIG. 3 shows the drying means *n* to *q* in a so-called circulated air system. The air quantity *l* is supplied to each duct. One quarter of the moistened air is discharged into the moist air header duct F, while three quarters remain in circulation and one quarter is made up from the dry air header duct T.

Figure 4:
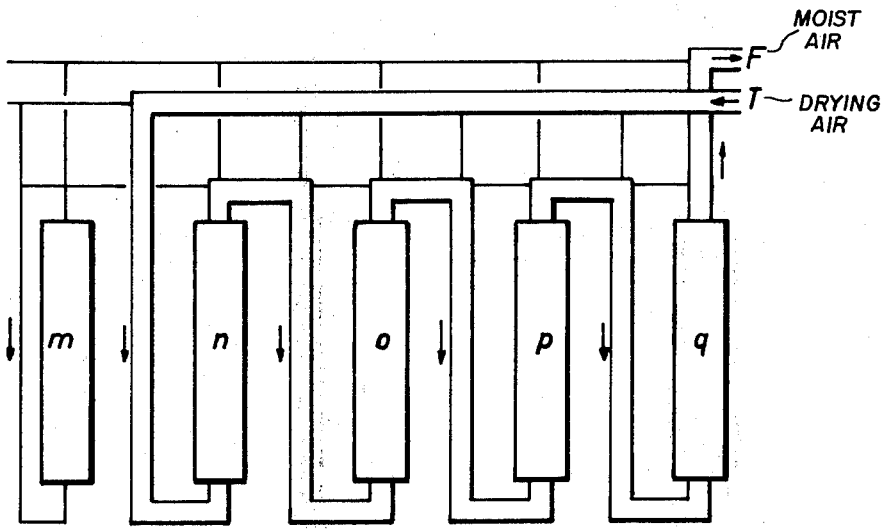

FIG. 4 shows the same drying means with a so-called helical system. The air quantity *l* taken from the duct T is sent successively through the sections *n* to *q* and, after having suitably absorbed moisture, is delivered into the duct F.

Figure 5:
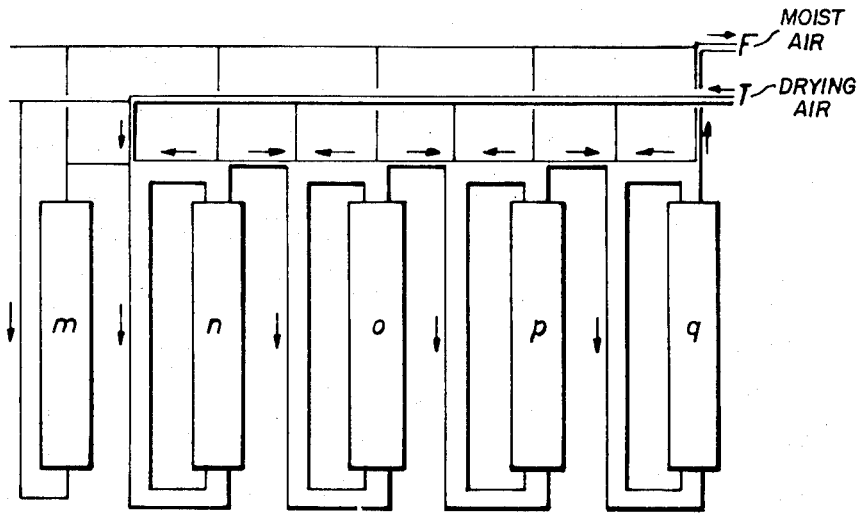
Figure 6:
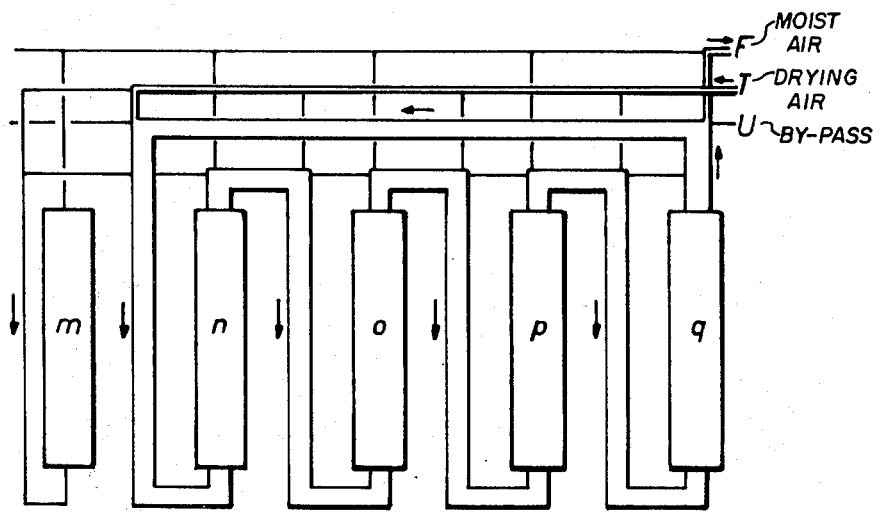

According to FIGS. 5 and 6, altogether only a quarter of the quantity of air circulated in each drying section is supplied to the drying means *n* to *q*. The dry air in this case is supplied before the section *n* and the moist air is discharged after the section *q*.

According to FIG. 5, always one quarter of the circulated air quantity is carried forward to the next drying section by means of a combined circulation and helical system.

On the contrary, according to FIG. 6, the strictly helical system as in FIG. 4 is retained and three quarters of the circulated air quantity is fed back fromn section *q* by way of the by-pass duct U to the section *n*.

Figure 7:
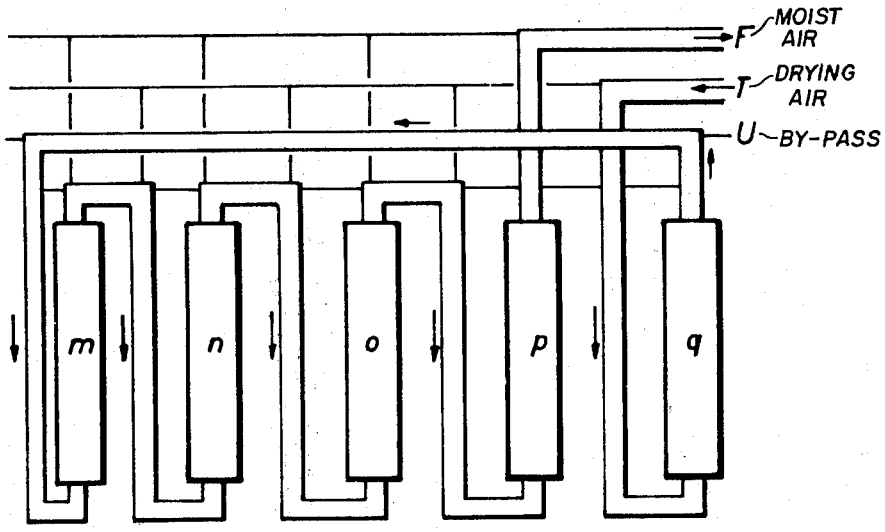
Figure 8:
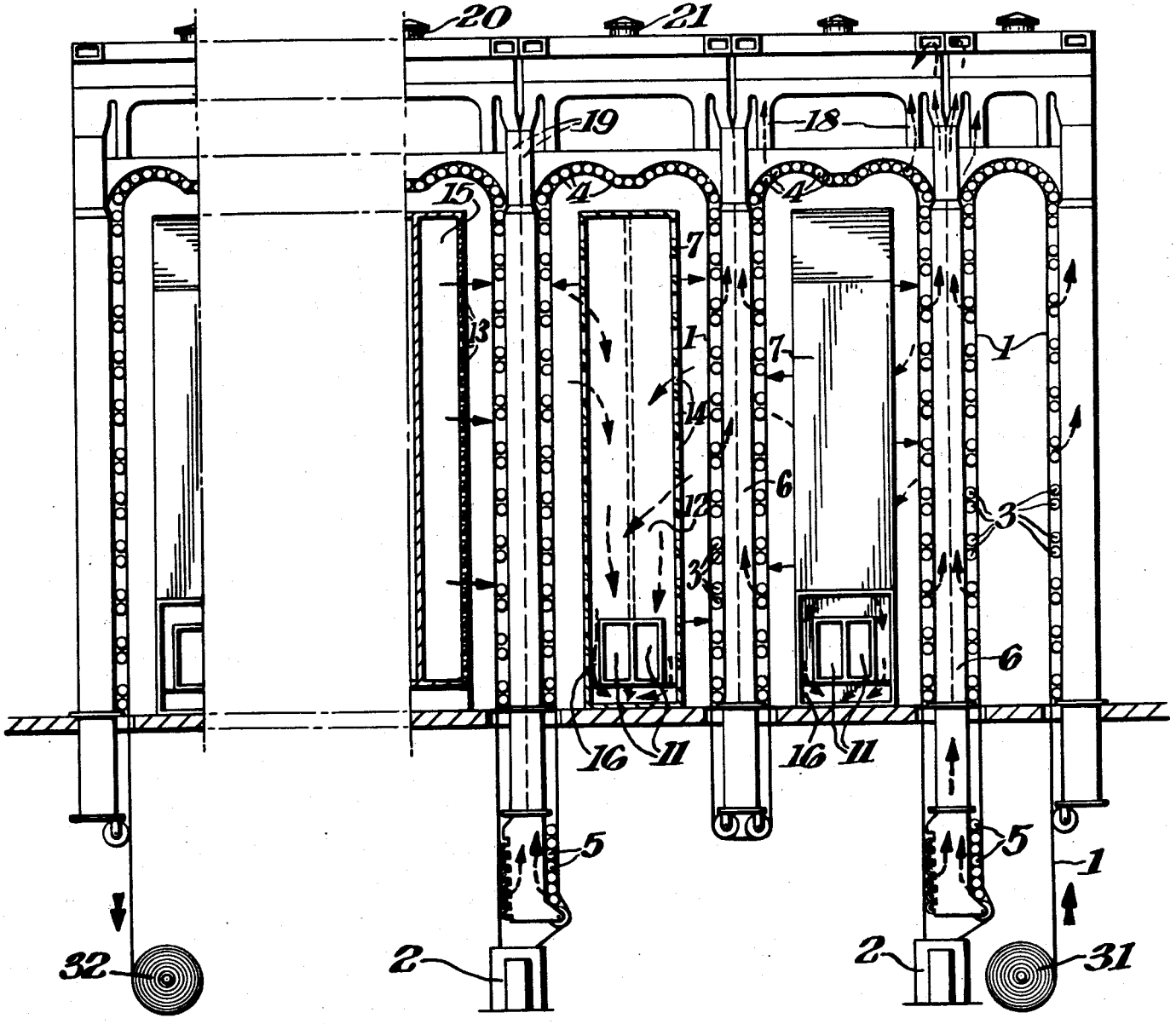
FIG. 8 is a cross-sectional view taken through FIG. 1 along the line 8—8.
Figure 9:
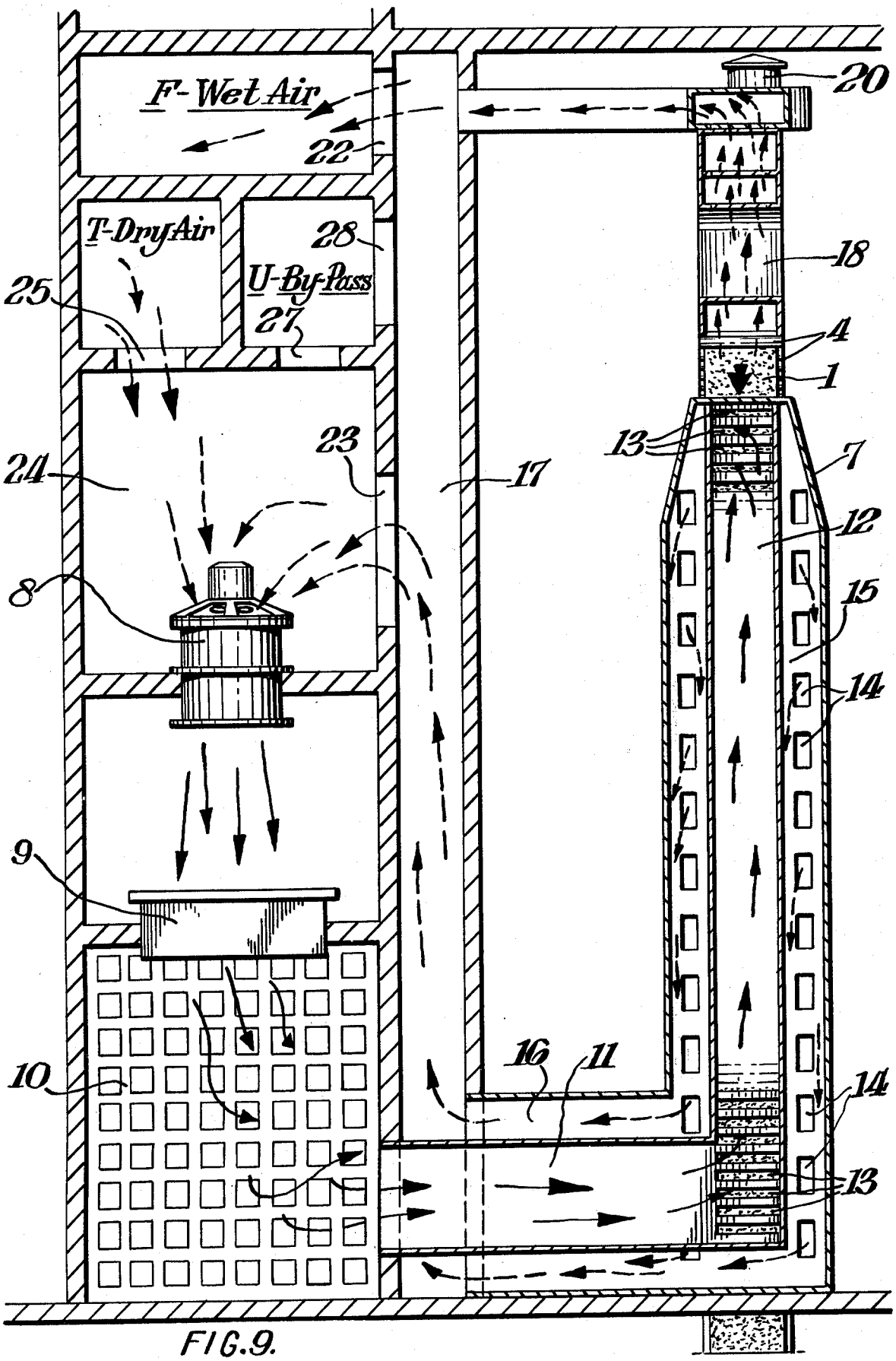
FIG. 9 is a cross-sectional view taken through FIG. 1 along the line 9—9.

FIG. 7 shows a system for the drying means *m* to *q*, in which the full air quantity is first of all supplied to the last section *q* and then through the by-pass duct U to the first section *m*. From the latter, the air is carried on in a helical system as far as the section *p*. This system is frequently used when the properties of the material being dried at the end and commencement of the drying section requires a drying air with a low wet bulb temperature, but higher temperatures of the material are permissible in the middle.

The systems which are shown in the diagrammatic FIGS. 3 to 7 can be combined in any arbitrary manner with a coating plant having a relatively large number of drying means, corresponding to the requirements of the drying operation.

Figure 2:
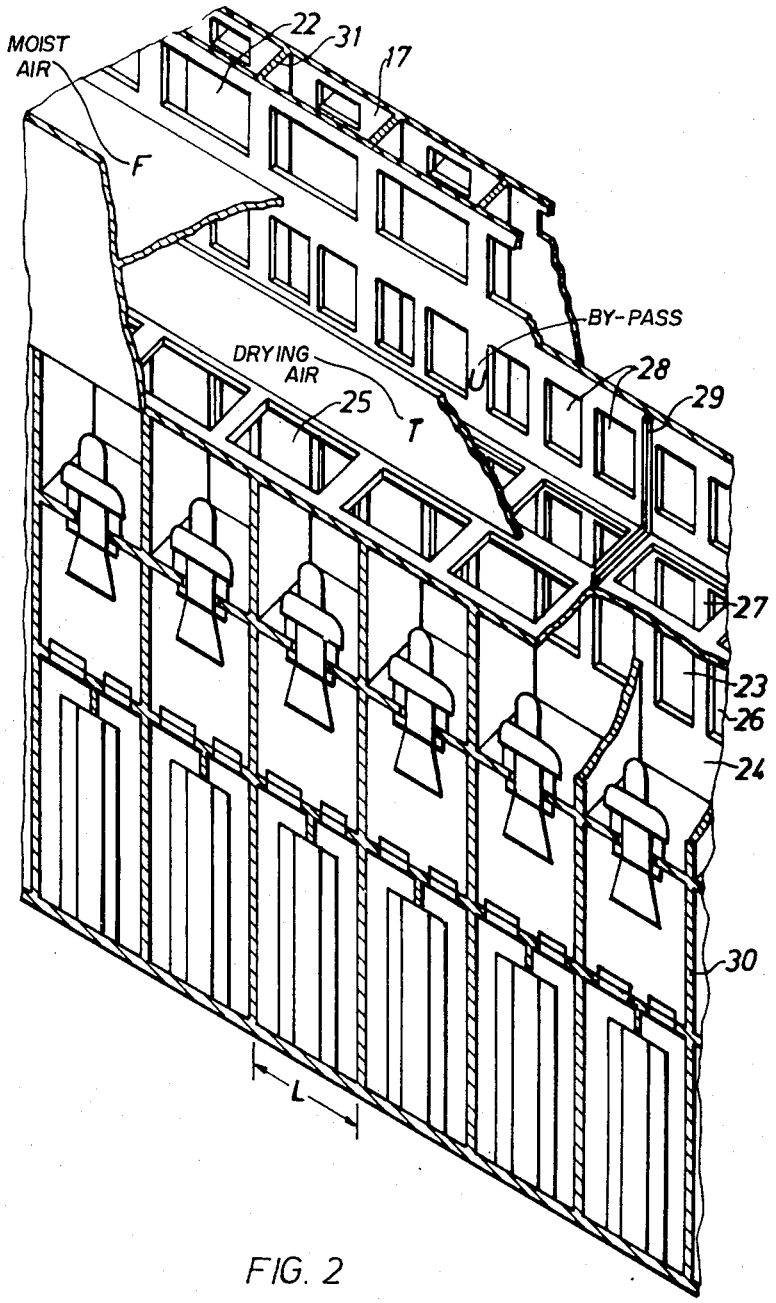
FIG. 2 is a perspective view in section through the coating and drying plant, from which the path of the air can be seen.

The air passages belonging to the separate systems are to be seen from FIGS. 1 and 2.

When operating with circulated air according to FIG. 3 in any drying section and as shown in the arrows in FIG. 1, a fan 8 blows the drying air through heater elements 9 and filters 10 and through the supply air ducts 11 into the nozzle ducts 12 in the housing 7 of the drying means. The air is blown through slit nozzles 13 on to the web 1 which is to be dried and discharges laterally over the edges of the web. The supply air path is symmetrically divided behind the heater element into two ducts. By this means, it is possible for the film web to have air blown thereon at different temperatures in different sections of the drying means. Most of the return air is drawn by suction through slots 14 into air discharge shafts 15 arranged laterally of the nozzle duct 12 and passes through the duct 16 into the return air duct 17.

A small part of the return air is drawn through the two-roller hollow-forming suction unit 3 and the curved suction unit 4 from the drying chamber and supplied through ducts 18 and 19 and fans 20 and 21, which produce the negative pressures necessary in the suction units, to the return air duct 17.

A small part of the total return air is removed from the cycle and conveyed through a damper 22 into the moist air header duct F. The remainder flows again through a damper 23 to the fan 8 arranged at the bottom of a mixing chamber 24. A portion corresponding to the discharged moist air quantity is removed by way of another damper 25 from the dry air header duct T and admixed in the mixing chamber 24 with the circulated air cycle. Dampers 26 and 27 remain closed when operating with circulated air.

With a helical air system according to FIGS. 4 to 7, the exhaust air is wholly or partially conveyed by way of the damper 26 to the fan of the adjacent chamber.

When using the by-pass duct U according to FIGS. 6 and 7, the latter is connected by way of dampers 28 to the required return air duct and by way of dampers 27 to the required mixing chamber. Depending on its length, the by-pass duct U can be subdivided by partitions 29 (FIG. 2), so that it can be used simultaneously for several air cycles.

As regards construction, the arrangement of the air passages in the upper part of the dry air duct (see FIG. 2) is advantageous. In this Figure, the important air chambers, such as the fan mixing chamber 24, return air duct 17, moist air header duct F, drying air header duct T, by-pass duct U, are constructed as a unit which is repeated in each structural element, and in the partitions of which are arranged the connecting dampers necessary for producing the different air circulation systems.

With the construction described here, the three ducts F, U and T run parallel to one another and have common partitions. The ducts F, U and T are preferably so disposed above the mixing chambers 24 that they pass through all mixing chambers. The return air ducts 17 respectively open vertically into the duct system F, U. The partitions 30 of adjoining mixing chambers 24 are offset relatively to the partitions 31 of adjoining return air ducts 17 by half the length L of a mixing chamber, so that some of the return air from the return air duct 17 can be directed through the corresponding dampers directly into two mixing chambers 24 which follow one another.

By means of this arrangement of the duct system and the mixing chambers, the aforementioned air circulation systems according to FIGS. 3 to 7 can be achieved with shortest possible air passages.

We claim:

1. An apparatus for the production of elongated foils coated with a plurality of photographic emulsion layers comprising a plurality of successively arranged coating stations and drying duct means having air supply and return conduits, characterized in that the foil is guided by a plurality of rollers in a meandering path having substantially parallel open loops including elongated straight portions and relatively short curved end paths with spaces inbetween the straight portions, the plurality of rollers being arranged in contact only with the uncoated side of the foil, suction duct chambers being disposed on the side of the rollers remote from the foil for applying a reduced pressure to maintain the foil in contact with the rollers and to withdraw some of the drying air, substantial spaces between the rollers on the uncoated surface of the foil leaving it extensively unobstructed, the drying duct means being arranged along the straight portions of the loops, the coating stations being arranged at the curved end paths of the meandering path of the foil in positions spaced by multiples of the length of one drying loop, the coating stations being disposed at the outside of the curved end paths at one side of the loops for applying and maintaining the coatings on one surface of the foil and inbetween alternate loops whereby the foil surfaces within successive loops being coated and uncoated, the suction duct chambers and the associated rollers being disposed within alternate loops of uncoated surfaces, the drying duct means being disposed within alternate loops having coated foil surfaces and having nozzle means for only discharging drying air against the coated foil surfaces, and control means connected to each of the air supply conduits for obtaining predetermined drying characteristics for the applied coatings within each of the loops having coated foil surfaces.

2. An apparatus according to claim 1 comprising a number of similar modules, each of the modules including an elongated suction chamber with rollers mounted on both sides thereof, a supply air conduit in the drying duct means with nozzle means on both sides thereof, a return air conduit in the drying duct means having intakes on both sides thereof, and a station for a coating means and associated emulsion supply means.

3. An appartus as set forth in claim 1 wherein return conduits are arranged adjacent the edge of the loops of coated foil surfaces for withdrawing most of the discharged drying air after impingement on the foil.

4. An apparatus for coating elongated foils on one side with several layers of emulsion comprising a series of elongated foil guidance and supporting assemblies having foil guidance and supporting elements, each of said assemblies having many foil guiding and supporting elements disposed in elongated open-ended loops for movable retaining contact of the uncoated side of said foils, a coating head connected to at least some of said assemblies for applying a layer of coating to one side of said foil being supported and guided by said assembly, said assemblies being disposed substantially parallel to each other with spaces therebetween, said loops being disposed in a sinous arrangement having straight and curved end paths, the coating stations being disposed at the outside of the curved end paths at one side of the loops for maintaining the coatings on one surface of the foil and inbetween alternate loops whereby the foil surfaces with successive loops being coated and uncoated, the elongated foil guidance and supporting assemblies being disposed within alternate loops having uncoated surfaces elongated drying duct means disposed within each of the alternate loops having coated surfaces for conducting a supply of drying air and directing it against the coated surfaces of said foil, the elongated drying duct means within the alternate loops having coated surfaces comprising an array of nozzle means disposed adjacent the coated side of the foil whereby a flow of drying air is impinged against the coated side of the foil, a suction chamber being disposed within the alternate loops having uncoated surfaces on the side of the foil guidance and supporting elements remote from the uncoated side of the foil whereby the pressure at the foil guidance elements is lowered for withdrawing a small portion of the drying air and holding the foil in firm contact against the foil guidance and supporting elements as the drying air is impinged against the coated surface of the foil, substantial spaces between the foil guidance and supporting elements on the uncoated side of the foil leaving it extensively unobstructed, and control means operatively associated with said drying duct means whereby the condition of said air within individual drying duct means is separately controlled to independently adjust the drying conditions for the section of the path of travel of said foil against which said individual drying duct means is directed.

5. An apparatus as set forth in claim 4 in combination with a source of drying air, connecting duct means including said control means between said source and said drying duct means, and said connecting duct means being adjustable whereby the condition of air within said drying duct means is varied.

6. An apparatus as set forth in claim 5 wherein said connecting duct means includes by-pass duct means.

7. An apparatus as set forth in claim 5 wherein said connecting duct means includes a supply duct, a return duct and a mixing chamber between said supply duct and said return duct, a blower in said mixing chamber, and adjustable damper means in said mixing chamber for varying the amount and manner of circulation of said air in each of said drying duct means.

8. An apparatus as set forth in claim 7 wherein said connecting duct means also includes bypass duct means and damper means in said bypass duct means for varying the amount of air circulated through and bypassed about each of said drying duct means.

9. An apparatus as set forth in claim 7 wherein mixing chamber partitions are disposed between adjacent mixing chambers and return air partitions are disposed between adjacent return ducts, and corresponding mixing chamber partitions are offset from said return air partitions by about one-half of the length of said mixing chamber.

10. An apparatus as set forth in claim 7 wherein heating and filtering chambers are disposed in line with each of said mixing chamber, moist air supplying duct means and dry air return air duct means are disposed substantially perpendicularly to each of said aligned mixing, heating and filtering chambers, and said connecting return and supply duct means connect said aligned mixing heating and filtering chambers, with each of said drying duct means.

11. An apparatus as set forth in claim 4 wherein said foil guiding and supporting elements comprise suction rollers.

12. An apparatus as set forth in claim 11 wherein substantially 180° curved arrays of said suction rollers are disposed at curved sections of said loops opposite the end paths.

13. An apparatus as set forth in claim 4 wherein said straight sections of said loops are substantially vertically disposed and said curved sections are disposed at the tops of said loops.

14. An apparatus as set forth in claim 4 wherein said elongated drying duct means include a central air discharge section and outer return air sections, elongated slit nozzles are provided in said central air discharge section for directing said drying air upon the coated surface of said foils, slots in said outer return air sections for receiving most of the drying air impinging on said foils, and the slots being disposed outside the edges of the foils.

15. An apparatus as set forth in claim 14 wherein each of the central air discharge sections are comprised of a pair of laterally associated conduits, said conduits being separate from each other and said conduits each having separate oppositely directed elongated slit nozzles.

16. An apparatus as set forth in claim 15 wherein the outer return air sections are disposed adjacent the sides of the conduits having slit nozzles therein.

17. An apparatus as set forth in claim 16 in combination with a source of drying air, connecting duct means including said control means between said source of drying air and said elongated drying duct means, said connecting duct means being adjustable whereby the condition of air within said elongated drying duct means is varied, return duct means being connected to the ends of return conduits at the open ends of the alternate loops having coated surfaces, return suction chamber ducts being connected to the ends of the suction chambers at the open ends of the alternate loops having uncoated surfaces, a return chamber connecting the return duct and return suction chamber ducts to the source of drying air, and drying means between the return chamber and the source of drying air wherein moisture is removed therefrom.

18. An apparatus as set forth in claim 17 wherein bypass means is provided in the return chamber for returning part of the moist return air directly to the source of dry air.

19. An apparatus as set forth in nclaim 18 wherein the return chamber is elongated.

20. An apparatus as set forth in claim 19 wherein the source of drying air comprises an elongated tower having blower means therewithin for inducing return air to flow from the return air chamber to the drying duct means.

21. An apparatus as set forth in claim 20 wherein adjustable return and bypass baffles are provided in the tower on the suction side of the blower.

22. An apparatus as set forth in claim 21 wherein the elongated foil guidance and supporting assemblies, the drying duct means, and straight sections of the loops and foil and associated elements are vertically disposed, and the return chambers and the tower are vertically disposed directly adjacent each pair of the elongated drying conduits.

23. An apparatus as set forth in claim 22 wherein the return chambers are vertically disposed between the elongated towers.

24. An apparatus as set forth in claim 4 wherein partitions are disposed in each of said drying duct means for separating them into two independent drying duct means for directing air on opposite sections of said foil.

25. An apparatus as set forth in claim 4 wherein said control means includes an air supplying chamber means is provided for supplying said air to each of said drying ducts, header means connecting said air supply chamber means with said drying duct means for providing a flow of air to said drying duct means and returning it to said air supplying chamber means, and adjustable damper means connected in each of said air supply means whereby the quantity of aif flowing through it may be adjusted.

26. An apparatus as set forth in claim 4 wherein each of said elongated foil guidance and supporting assemblies comprises an elongated suction duct, a series of foil guiding rollers disposed on two sides of said elongated duct for guiding said foil around it, and suction connections from said elongated suction duct to said foil guiding rollers whereby said foil is held by suction against said foil guiding rollers.

27. An apparatus as set forth in claim 26 wherein said coating head is connected to one end of said elongated suction duct, and a plurality of said foil guiding rollers are disposed in a convex arrangement relative to said coating head for firmly and smoothly guiding said foil in the vicinity of said coating head.

28. An apparatus as set forth in claim 26 wherein a substantially 180° curved set of foil guiding rollers and corresponding suction duct means connects one foil guidance and supporting assembly with the next around the end of a drying duct means disposed inbetween said assemblies.

29. An apparatus as set forth in claim 4 wherein each of said coating heads comprise coating applying means and emulsion storage means and each of said coating heads being disposed at one end of an elongated foil guidance and supporting assembly.

30. An apparatus as set forth in claim 13, wherein said foil guidance and supporting assemblies include unwinding and winding arrangements for supplying said foil to and receiving said foil from said loops.

* * * * *